US008955706B2

(12) United States Patent
Gagnebin

(10) Patent No.: US 8,955,706 B2
(45) **Date of Patent: *Feb. 17, 2015**

(54) VACUUM-OPERATED TRASH RECEPTACLE

(76) Inventor: Rock A. Gagnebin, Hutchinson, KS (US)

( * ) Notice: Subject to any disclaimer, the term of this patent is extended or adjusted under 35 U.S.C. 154(b) by 154 days.

This patent is subject to a terminal disclaimer.

(21) Appl. No.: 12/939,628

(22) Filed: Nov. 4, 2010

(65) Prior Publication Data

US 2011/0100997 A1 May 5, 2011

Related U.S. Application Data

(63) Continuation-in-part of application No. 10/822,928, filed on Apr. 13, 2004, now Pat. No. 7,828,168.

(60) Provisional application No. 60/464,055, filed on Apr. 21, 2003.

(51) Int. Cl.

| | |
|---|---|
| ***B65D 25/14*** | (2006.01) |
| ***B65D 35/14*** | (2006.01) |
| ***B65D 21/02*** | (2006.01) |
| ***B65F 1/06*** | (2006.01) |
| ***B65F 1/08*** | (2006.01) |

(52) U.S. Cl.

CPC ... *B65F 1/06* (2013.01); *B65F 1/08* (2013.01); *B65F 2210/179* (2013.01); *B65F 2250/11* (2013.01); *B65F 2250/1143* (2013.01); *B65F 2250/1146* (2013.01); *Y10S 220/908* (2013.01)

USPC ..... 220/495.04; 220/495.08; 220/23.87; 220/908

(58) Field of Classification Search

USPC ..... 220/495.04, 495.08, 908, 908.1, 220/495.06, 495.11, 23.83, 23.86, 23.87; 3/495.04, 495.08, 908, 908.1, 495.06, 3/495.11, 23.83, 23.86, 23.87

See application file for complete search history.

(56) References Cited

U.S. PATENT DOCUMENTS

| | | | | |
|---|---|---|---|---|
| 1,424,520 | A * | 8/1922 | Richardson et al. | 220/254.2 |
| 2,364,012 | A | 11/1944 | Walton et al. | |
| 2,678,764 | A * | 5/1954 | Carlson | 141/390 |
| 3,167,209 | A | 1/1965 | Jones | |
| 3,556,186 | A * | 1/1971 | Besthorne et al. | 383/3 |
| 3,815,778 | A * | 6/1974 | Martin | 220/495.11 |
| 4,293,111 | A * | 10/1981 | Henri | 248/95 |

(Continued)

*Primary Examiner* — Bryon Gehman

*Assistant Examiner* — Shawn M Braden

(74) *Attorney, Agent, or Firm* — Preti Flaherty Beliveau & Pachios LLP

(57) ABSTRACT

A vacuum-operated trash receptacle which is characterized by a container fitted with an air blower, vacuum pump or the like, either on the perforated lid, bottom or on the side thereof and having a like-shaped, removable, typically slotted liner inserted therein. In a preferred embodiment, the outer wall or walls and/or bottom of the liner are spaced from the corresponding inside wall or walls and bottom panel of the container, respectively, to define a separate or connected annulus between the bottom and wall or walls of the container and liner. The container is further provided with a top flange which receives a corresponding liner flange on the liner to seal the separate or connected bottom and wall annulus and facilitate development of a vacuum in the bottom annulus and wall annulus or both and in the liner by operation of the air blower. This vacuum operates to deploy a trash bag against the inside wall of the liner, either when the container is open or when a perforated lid is fitted over the container to close the liner. The embodiments provide for timed development of the vacuum, use of a bottomless liner, with or without pleats and a liner with a pre-installed bag.

12 Claims, 6 Drawing Sheets

(56) References Cited

U.S. PATENT DOCUMENTS

| | | | | | |
|---|---|---|---|---|---|
| 4,294,379 | A | | 10/1981 | Bard | |
| 4,961,514 | A | * | 10/1990 | Palmer | 220/23.87 |
| 5,143,242 | A | | 9/1992 | Millasich | |
| 5,156,290 | A | * | 10/1992 | Rodrigues | 220/87.1 |
| 5,170,906 | A | | 12/1992 | Kochelek | |
| 5,263,520 | A | | 11/1993 | Arai | |
| 5,374,118 | A | * | 12/1994 | Kruck et al. | 312/407 |
| 5,388,717 | A | | 2/1995 | LeVasseur | |
| 5,474,201 | A | * | 12/1995 | Liu | 220/23.87 |
| 5,492,241 | A | | 2/1996 | Barnett et al. | |
| 5,662,235 | A | * | 9/1997 | Nieto | 220/23.86 |
| 6,000,571 | A | * | 12/1999 | Brooks et al. | 220/495.04 |
| 6,076,694 | A | * | 6/2000 | Ragot | 220/23.83 |
| 6,223,927 | B1 | * | 5/2001 | Rand | 220/495.06 |
| 6,474,495 | B1 | | 11/2002 | Frei | |
| 6,554,151 | B1 | | 4/2003 | Brennan | |
| 7,086,569 | B2 | * | 8/2006 | Stravitz | 222/157 |
| 7,273,155 | B1 | * | 9/2007 | Gray | 220/495.04 |
| 2004/0175303 | A1 | * | 9/2004 | Lin | 422/186.3 |
| 2004/0206760 | A1 | * | 10/2004 | Gagnebin | 220/495.04 |
| 2004/0238541 | A1 | | 12/2004 | Camp, Jr. | |
| 2004/0238542 | A1 | | 12/2004 | Camp, Jr. et al. | |
| 2005/0199632 | A1 | * | 9/2005 | Anderson | 220/495.01 |
| 2006/0175336 | A1 | * | 8/2006 | Wang | 220/495.04 |

* cited by examiner

VACUUM-OPERATED TRASH RECEPTACLE

CROSS-REFERENCE TO RELATED APPLICATIONS

This application claims the benefit of and incorporates by reference prior filed U.S. Provisional Patent Application Ser. No. 60/464,055, filed Apr. 21, 2003 and is a continuation-in-part of U.S. patent application Ser. No. 10/822,928 filed on Apr. 13, 2004 now U.S. Pat. No. 7,828,168.

BACKGROUND OF THE INVENTION

Trash handling, particularly in institutional environments, is a less than pleasant activity. This is due in part to the practice of containers with a manual deployment that involves time and prolonged contact with a possibly germy piece of equipment. The invention facilitates the ability to retrofit existing trash receptacles for vacuum-operated trash receptacle operations.

SUMMARY OF THE INVENTION

This invention includes a vacuum-operated trash receptacle which is characterized in a preferred embodiment by a cylindrical container having a top flange that receives a perforated lid or cover and a cylindrical liner which is smaller in diameter and typically shorter than the container, fitted inside the container and provided with a top flange and slots or openings in the wall thereof. A trash receptacle or bag is placed inside the liner and in a first preferred embodiment an electric air blower or inflator or a vacuum pump (hereinafter called air blower) is provided in the bottom of the container and communicates with an annulus defined by the liner bottom and the container bottom and optionally, the outside liner wall and the inside container wall. The liner has slotted holes over its length.

This structure facilitates the development of a vacuum inside the liner and the annulus, with corresponding deployment of the wall of the trash bag against the liner from top to bottom to optimize deployment of the trash bag to full volume inside the liner for containing trash by operation of the air blower. In a second embodiment of the invention the air blower is positioned in the side or wall of the container and communicates with the annulus between the outside liner wall and the inside container wall, to effect the same vacuum in the liner and annulus and optimum deployment of the trash bag in the liner. In a third embodiment an air blower is mounted on the inside of the lid or cover and the liner flange is omitted from the liner or is perforated, for introducing air directly into the trash bag and deploying the bag against the liner. A timer circuit is added to allow unattended deploying of the bag within the liner.

A bottomless liner is alternatively provided, with or without pleating and with or without a separate drip pan. A portable vacuum source may be substituted for the built-in blower.

BRIEF DESCRIPTION OF THE DRAWINGS

The invention will be better understood by reference to the following drawings wherein.

DESCRIPTION OF THE PREFERRED EMBODIMENTS

Figure 1:
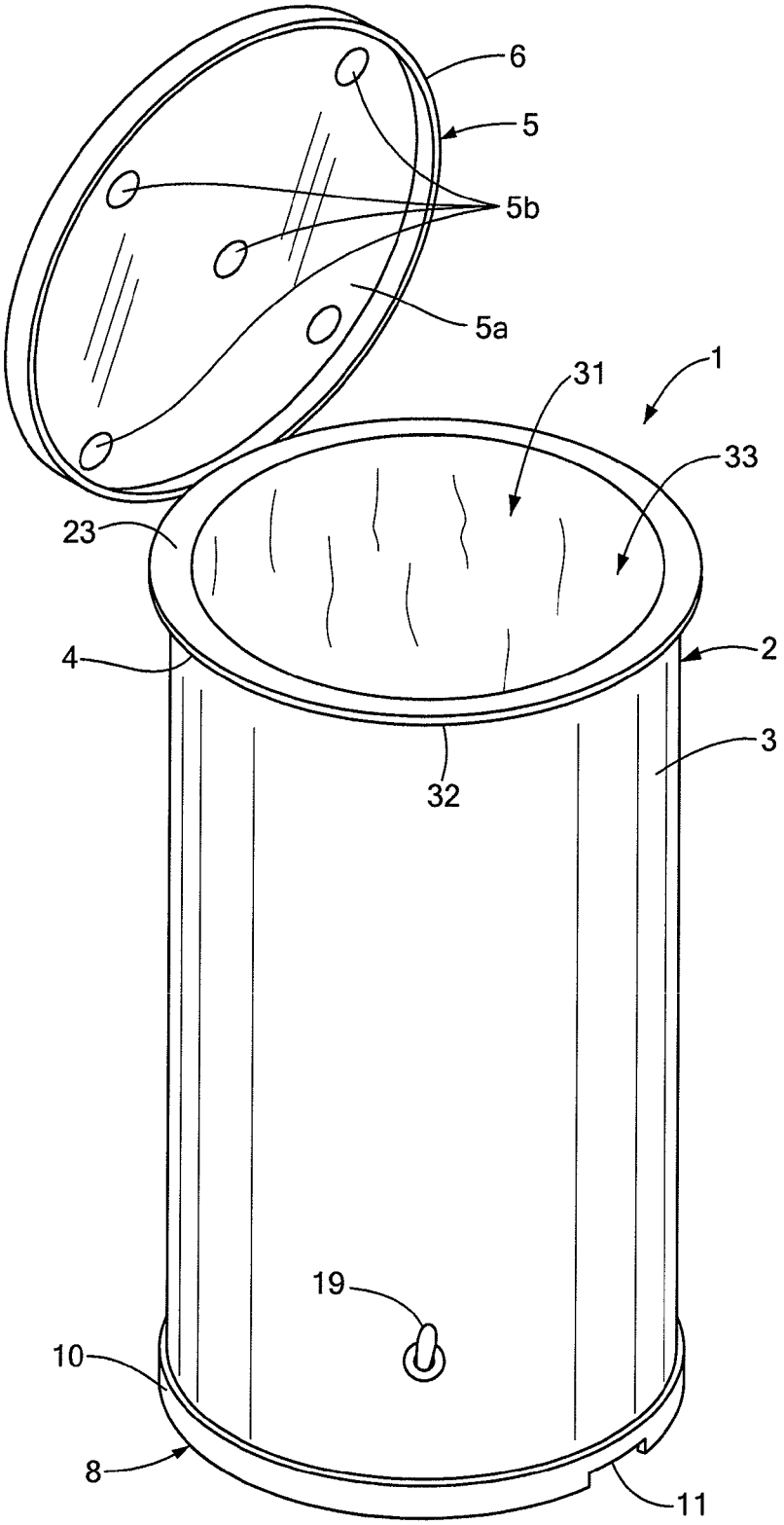
FIG. 1 is a perspective view of a first preferred embodiment of the vacuum-operated trash receptacle having a bottom-mounted air blower, with the trash bag deployed in the liner and the liner located in functional configuration inside the container.
Figure 2:
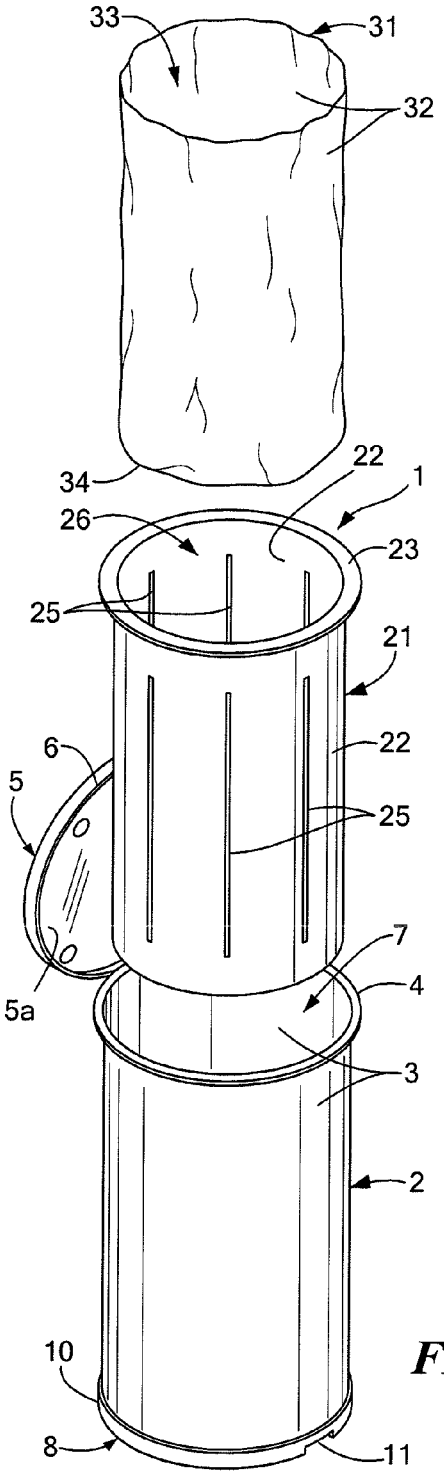
FIG. 2 is an exploded view of the vacuum-operated trash receptacle illustrated in FIG. 1, more particularly illustrating the slotted liner and the trash bag, both disposed for deployment in the container.
Figure 3:
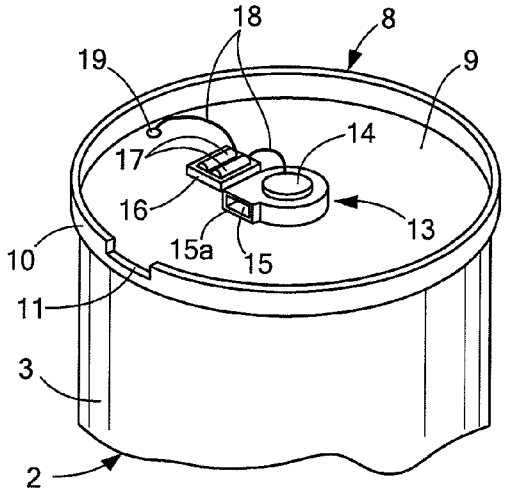
FIG. 3 is an inverted view, partially in section, of the bottom segment of the vacuum-operated trash receptacle illustrated in FIGS. 1 and 2, illustrating the air blower mounted in the bottom panel of the container.
Figure 4:
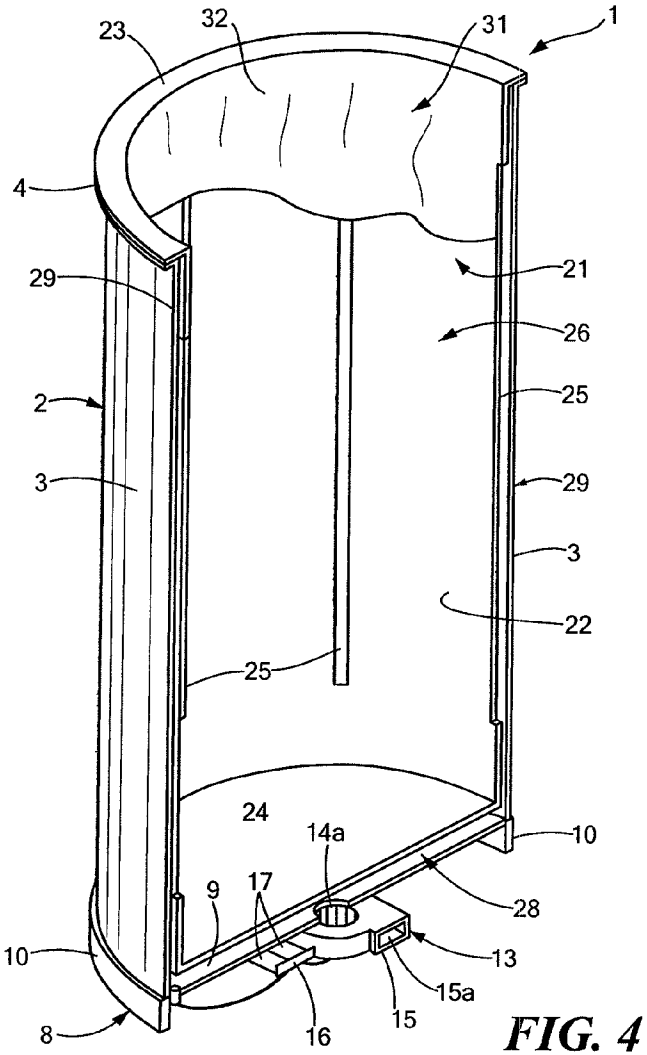
FIG. 4 is a longitudinal sectional view of the container illustrated in FIG. 1, with the liner in place in the container and the trash bag positioned inside the liner, more particularly illustrating the connected bottom and side or wall annulus formed between the respective bottom and wall of the liner and the container for generating a vacuum inside the liner adjacent to the trash bag when the air blower is operating.

Referring initially to FIGS. 1-4 of the drawings in a first preferred embodiment the vacuum-operated trash receptacle of this invention is generally illustrated by reference numeral 1. The vacuum-operated trash receptacle 1 is characterized by a typically cylindrical container 2, defined by a cylindrical container wall 3, fitted with a container flange 4 at the top thereof and having a round cover or lid 5, provided with lid openings 5*b* and optionally, with a downwardly-extending lid flange 6 deployed around the periphery of the lid panel 5*a* of the lid 5. The container wall 3 extends to a container bottom 8, having a container-supporting panel flange 10 extending around a bottom panel 9, to define a container interior 7, as further illustrated in FIG. 2 of the drawings. A panel flange slot 11 is provided in the panel flange 10 of the container bottom 8 to assure a continuous flow of air to the air blower 13, having a blower suction 14 mounted in an opening provided in the bottom panel 9 of the container bottom 8, as illustrated in FIGS. 3 and 4. The blower suction 14 is characterized by a suction opening 14*a* that extends through the opening in the bottom panel 9, as illustrated in FIG. 4 and communicates with a bottom annulus 28, defined by the liner bottom 24 of a liner 21 inserted in the container 2, and the bottom panel 9 of the container bottom 8. A battery container 16 is typically mounted on the bottom panel 9 adjacent to the air blower 13 and contains one or more batteries 17, having wiring 18 connected to the air blower 13 and a switch 19, according to the knowledge of those skilled in the art, for operating the air blower 13 by means of the switch 19. Alternatively, the blower 13 and switch 19 can be wired for 115-volt household current or the like, as desired. The liner 21 is characterized by a cylindrical liner wall 22 which is typically smaller in diameter than the container wall 3 of the container 2, to facilitate a wall annulus 29, that typically connects to the bottom annulus 28, as further illustrated in FIG. 4 of the drawings. One or more liner wall slots 25 of selected number, length and width are provided in the liner wall 22 to facilitate air communication between the liner interior 26 and the wall annulus 29. A liner flange 23 extends around the top periphery of the liner wall 22 and fits over the container flange 4 of the container wall 3 when the liner 21 is fully inserted inside the container 2, to seal the wall annulus 29, space the liner bottom 24 from the container bottom 8 and define and seal the bottom annulus 28, as illustrated in FIGS. 1 and 4 of the drawings. The liner wall 22 and liner bottom 24 of the liner 21 define the liner interior 26 that accommodates a trash bag 31, as further illustrated in FIGS. 1, 2 and 4. The trash bag 31 is conventional in design and includes a flexible or resilient trash bag wall 32, with a trash bag bottom 34, defining a trash bag interior 33 for containing trash, as further illustrated in FIG. 2.

In operation of the embodiment described above and referring again to FIGS. 2 and 4 of the drawings, under circumstances where it is desired to deploy the trash bag wall 32 and the trash bag bottom 34 of a trash bag 31 against the liner wall 22 of the liner 21 inside the container 2, the lid 5 is typically, but not necessarily, seated on the liner flange 23 to close the liner 21 and the container 2 and the air blower 13 is operated by manipulating the switch 19 to the "on" position. The air blower 13 is typically energized by the batteries 17 and air is caused to flow into the trash bag 31 through the lid openings 5*b*, if the lid 5 is in place on the container 2, or directly into the trash bag 31, if not air also flows from the liner interior 26 of the liner 21, through the liner wall slots 25 and from the bottom annulus 28 and the wall annulus 29, into the suction opening 14*a* of the air blower 13. The air continues to flow through the blower discharge opening 15*a*, to create a vacuum inside the liner 21, between the inside wall of the liner 21 and the flexible, resilient trash bag 31. This vacuum causes the trash bag wall 32 and the trash bag bottom 34 to fully deploy against the inside liner wall 22 and liner bottom 24, respectively, and facilitate complete filling of the trash bag 31, utilizing the full volume of the trash bag interior 33. After deployment of the trash bag 31 in the liner 21, the switch 19 is turned to the "off" position, or may be alternatively wired to automatically terminate operation of the air blower 13 by use of a timer or the like, with the trash bag 31 remaining in fully deployed configuration inside the liner 21 for filling with trash.

Figure 5:
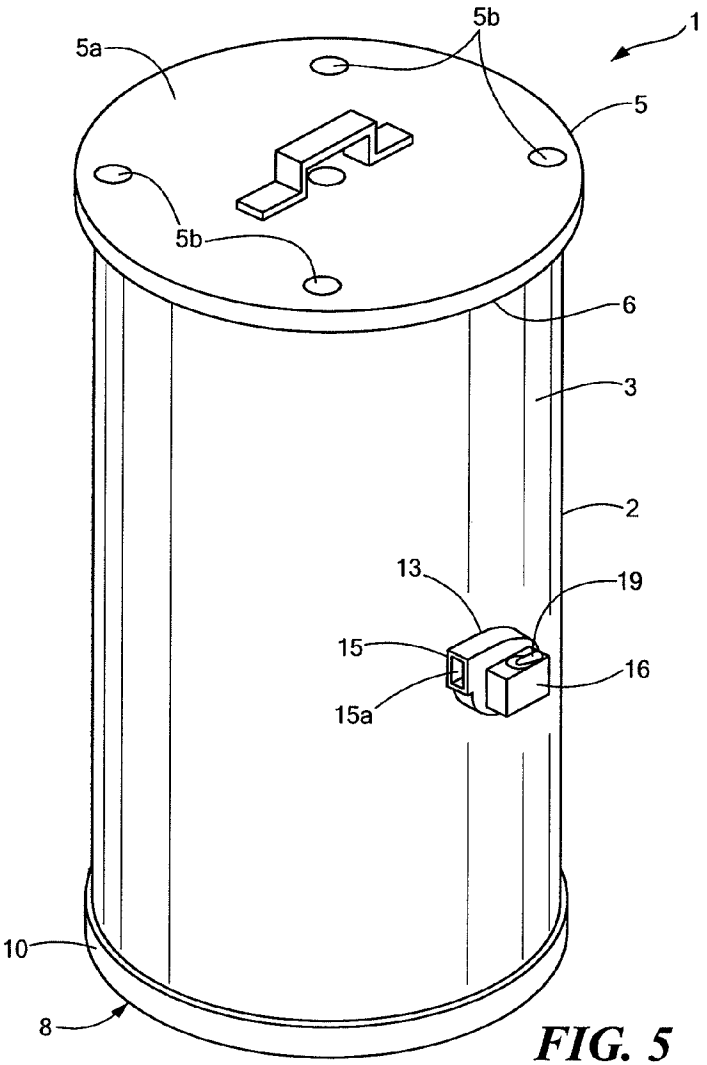
FIG. 5 is a perspective view of a second preferred embodiment of the vacuum-operated trash receptacle, wherein the air blower is mounted in the wall of the container.
Figure 6:
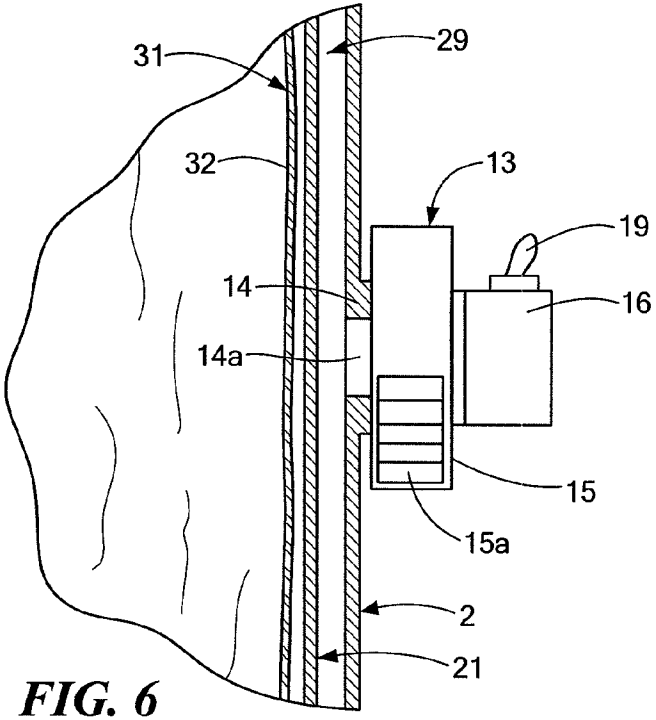
FIG. 6 is a sectional view of the wall of the container illustrated in FIG. 5, more particularly illustrating the wall-mounted air blower detail with the blower suction in communication with the wall annulus between the outside wall of the liner and the inside container wall.

In another embodiment of the invention the air blower 13 is mounted on the container wall 3 of the container 2 as illustrated in FIGS. 5 and 6 of the drawings. In this embodiment the blower suction 14 is secured to the container wall 3 of the container 2 and the suction opening 14*a* communicates with an opening in the container wall 3 and the wall annulus 29, as illustrated in FIG. 6 to facilitate operation of the air blower 13 and expelling air from the liner interior 26, the wall annulus 29 and the bottom annulus 28, since the bottom annulus 28 is connected to the wall annulus 29, to fully deploy the trash bag 31 inside the liner 21 in the same manner as illustrated in FIGS. 1 and 4 of the drawings and as described above. Accordingly, under circumstances where the air blower 13 is mounted on the container wall 3 of the container 2 as illustrated in FIGS. 5 and 6 of the drawings, when the switch 19 is manipulated to the "on" position, the air blower 13 is operated to cause air to flow from the liner interior 26, through the liner wall slots 25 and into the wall annulus 29. Air continues to flow from the wall annulus 29 and the connected bottom annulus 28, through the suction opening 14*a* of the blower suction 14 and from the air blower 13 through the blower discharge opening 15*a* of the blower discharge 15. Accordingly, a vacuum is generated in the liner 21 and this vacuum causes the trash bag wall 32 to fully deploy against the liner wall 22 of the liner and the trash bag bottom 34 to seat against the liner bottom 24, and allow optimum use of the trash bag interior 33 for receiving trash. As in the first embodiment of the invention, when the switch 19 is manually turned to the "off" position, or is deployed in "automatic" mode according to the knowledge of those skilled in the art, operation of the air blower 13 is terminated and the trash bag 31 remains deployed in an optimum trash-receiving configuration inside the liner 21 of the vacuum-operated trash receptacle 1.

Figure 7:
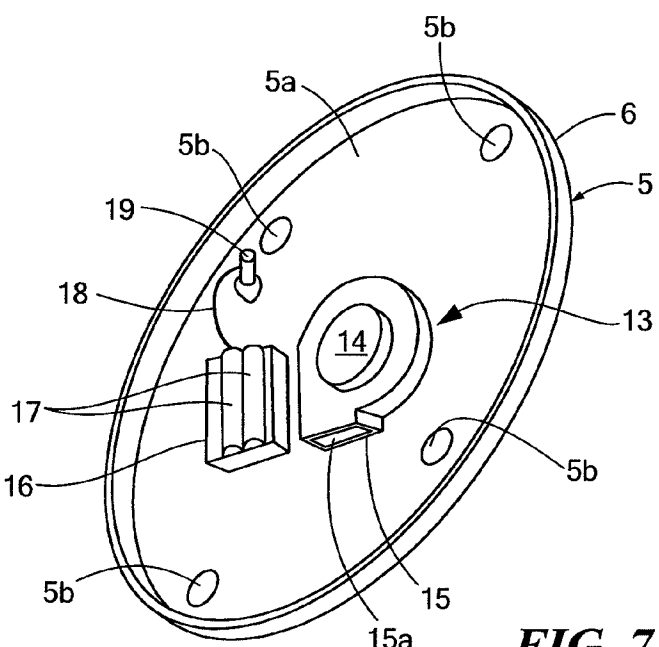
FIG. 7 is a perspective view of a perforated container cover or lid fitted with a blower for introducing air directly into the trash bag and deploying the trash bag against the liner or container under circumstances where the liner flange is perforated or omitted from the liner.

Referring now to FIG. 7 of the drawings in a third embodiment of the invention, the blower 13 is mounted on the inside of the lid panel 5*a* of the lid 5, along with a battery container 16 and batteries 17 and a switch 19, with the blower 13 deployed to eject air from the blower discharge 15 into the trash bag 31 and deploy the trash bag 31 in the container 2 using a perforated liner 21 or one that has no liner flange 23. This liner configuration allows air to flow from around the trash bag 31, through the liner wall slots 25 and from the side annulus 29 at the top thereof, due to the increase in air pressure inside the trash bag 21.

It will be appreciated by those skilled in the art that the vacuum-operated trash receptacle 1 of this invention is characterized by convenience and flexibility, in that while the container 2 and liner 21 are illustrated as cylindrical in configuration, other cross-sectional configurations, including various polygons, such as a square, hexagon, pentagon and the like, can be utilized to shape the container wall 3 and the corresponding liner wall 22, as well. Furthermore, openings such as variously shaped holes other than the liner wall slots 25 may be provided in the liner wall 22 of the liner 21 to facilitate creation of a vacuum in the liner interior 26 by operation of the air blower 13 or an alternative inflating or pressurizing device or a vacuum pump of choice. In addition, the air blower 13 can be operated by direct current supplied by the batteries 17 or by alternating current, as described, and can be placed at any desired location between the container flange 4 of the container wall 3 and the panel flange 10 at the bottom of the container wall 3, as well as on the lid 5 and may be sized to handle the air flow from a liner 21 of selected size and volume, as desired. Likewise, the switch 19 can be placed at any desired and convenient location on the container bottom 8, the container wall 3 or on the lid 5, according to the desires of the user.

It will be appreciated that the liner 21 can be sized to fit inside the container 2 snugly or loosely, such that either a bottom annulus 28 or a wall annulus 29 is formed, and the air blower 13 then positioned to locate the blower suction 14 accordingly. In the case of only the bottom annulus 28, an opening or openings (not illustrated) must be provided in the liner bottom 24 to facilitate creation of the desired vacuum in the liner interior 26 of the liner 21.

It will be further appreciated by those skilled in the art that the materials of construction of the container 2 and the liner 21 of the vacuum-operated trash receptacle 1 can be varied, although in a preferred embodiment the container 2 and the liner 21 are constructed of metal or of a plastic material such as polyethylene, polypropylene and the like, in non-exclusive particular, for simplicity and minimum expense in fabrication, weather resistance, lightness of weight and optimum longevity. Furthermore, the container 2 and the liner 21 can be constructed of any desired size to receive standard-sized trash bags 31, according to the knowledge of those skilled in the art.

While the preferred embodiments of the invention have been described above, it will be recognized and understood that various modifications may be made in the invention and the appended claims are intended to cover all such modifications which may fall within the spirit and scope of the invention.

A further embodiment of the invention adds a timer to allow the blower to be activated for one or more set time intervals. This increases the efficiency of the use of the invention in environments having several trash containers according to the invention. A trash collection crew can make faster rounds collecting trash from several containers by, after a new bag has been placed in the liner, activating the blower for a fixed interval selected from one or more intervals depending on the trash container characteristics. Once the blower is activated, the crew member can move on to the next container while the new bag inserted in the just emptied container deploys unattended into the liner as described above. The time interval is selected to shut off the blower after a time sufficient for the new bag to fully deploy.

Figure 8:
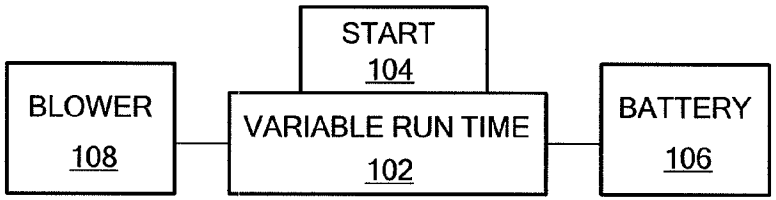
FIG. 8 shows a block diagram of a timing circuit for operating an air pump.

FIG. 8 illustrates this embodiment having a timer 102 from which one or more time intervals may be selected according to the type of container as described above. The time interval selected is activated by a start button or switch 104, connecting power from a battery 106 to blower 108, all largely as described above.

Figure 9:
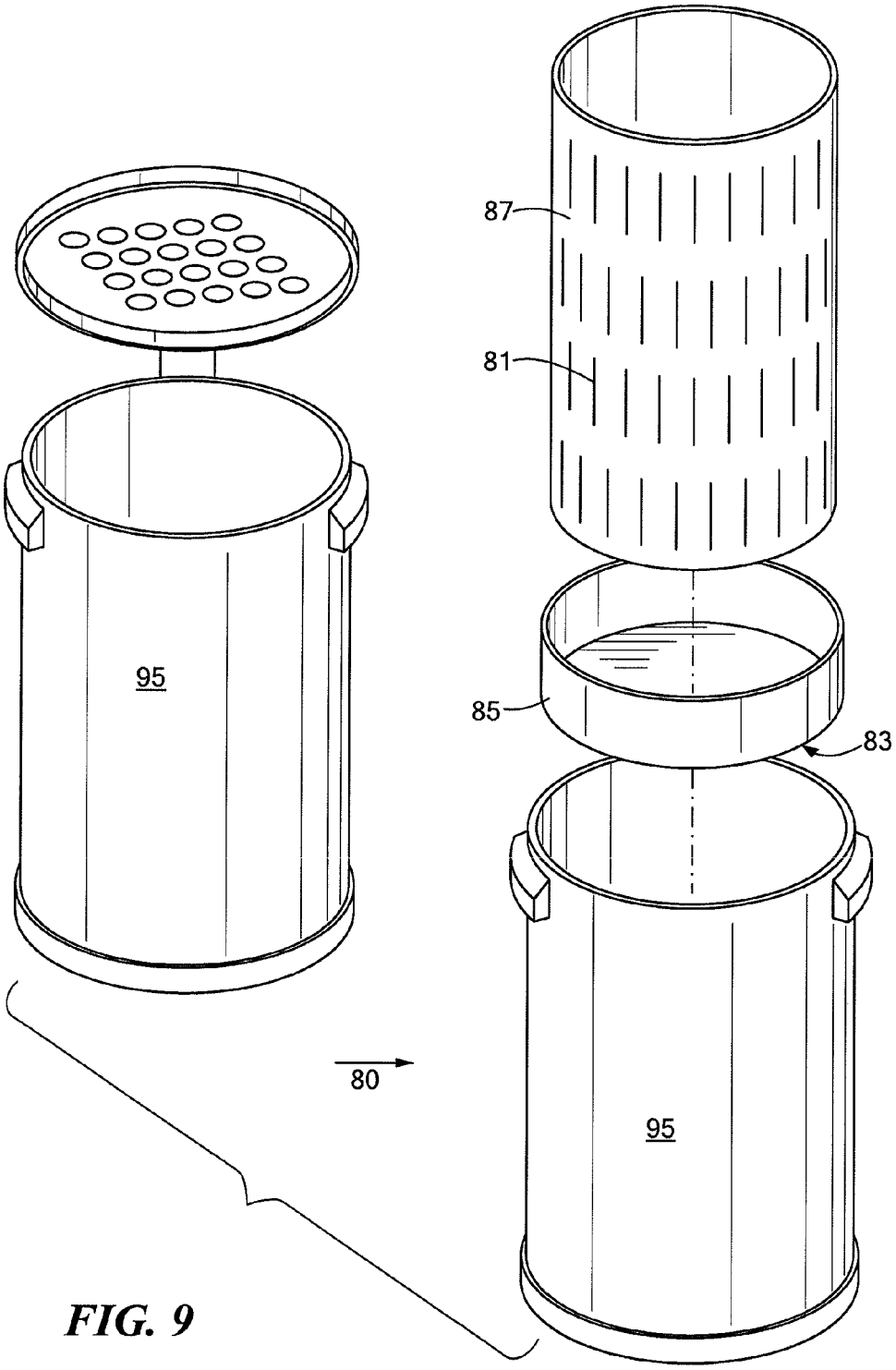
FIG. 9 shows a diagrammatic view of a liner and drip pan combination.

In yet a further embodiment as shown in FIG. 9, a perforated liner 81 may be provided without a bottom in which case its sides 87 would rest upon a bottom 183 of the trash container 118 or a drip pan 85 may be provided as shown with the liner 81 resting on its bottom or hanging from the container rim.

A blower 88, as described above, is provided to withdraw air from the spaces 124 and 126 (in the case of drip pan 85) allowing deployment of a trash bag as described above.

The bottomless liner 81 reduces production costs and may even allow for bag pre-deployment by a collection crew allowing liner and deployed bag to be installed together.

Figure 10:
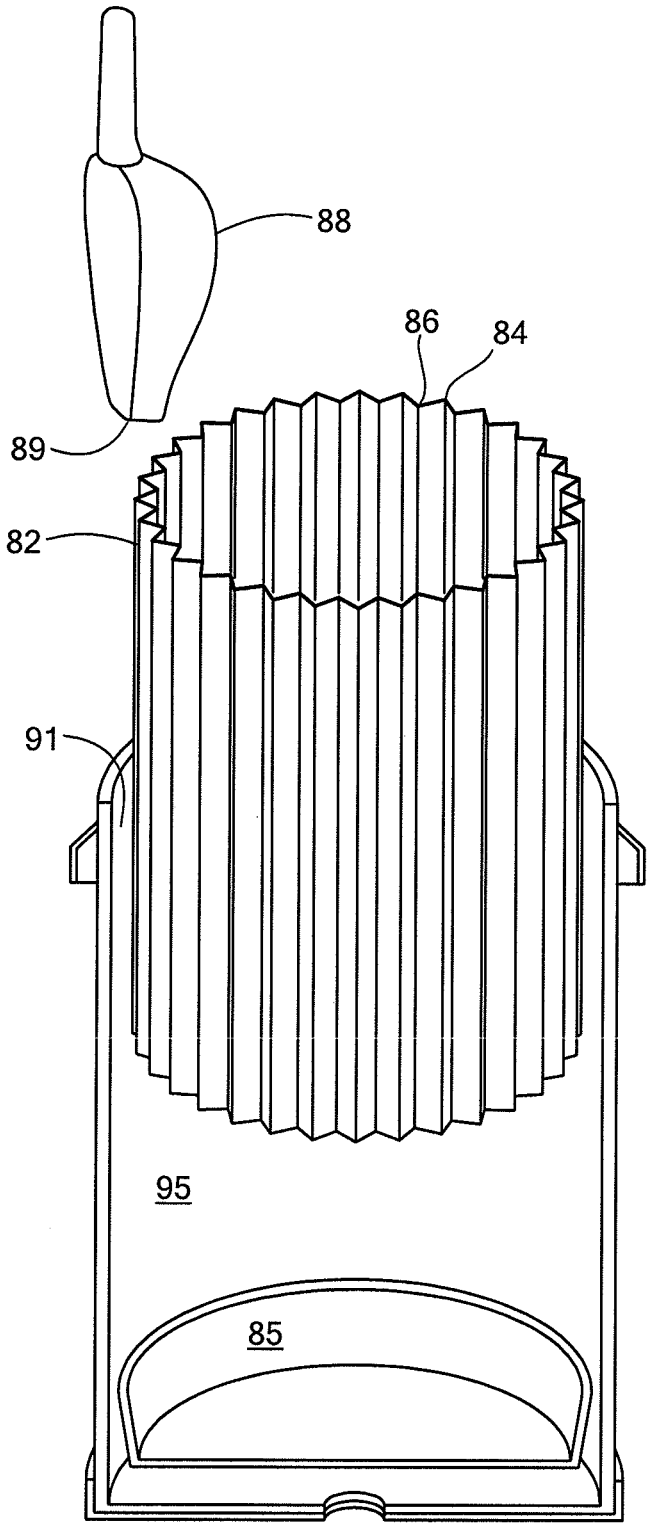
FIG. 10 shows a diagrammatic view of a pleated liner embodiment.

A further embodiment is shown in FIG. 10 in which the liner 82 is pleated, may be slightly porous or perforated with folds. The pleats help to support such a liner and allow for the installation into any trash receptacle configuration or shape to facilitate vacuum-operated trash receptacle operations or retrofitting thereof. The liner 82 is bottomless and installed in a container 95 as described above with respect to FIG. 9. The blower permanently installed in the container as described above, may be eliminated to save costs. In its place a portable vacuum pump 89, or hand-held, dust buster-type vacuum device, can be used by supplying its suction head 89 into the annulus 91 between the liner 82 and container 95 via an entry port 142 in the container at its rim edge or valleys created by the pleats and side wall. The vacuum thus generated draws air down the space formed by the pleats on the inside of the liner 82 and through the pores or perforations, thus successively closing as the trash bag deploys downward.

Alternative apertures are provided at the bottom of the liner to allow air to flow from inside the liner 82 between it and a bag inserted for deployment in inner space. The folds act as traps to hold the bag against the line as it deploys down into the liner.

What is claimed is:

1. A vacuum-operated trash receptacle comprising:

a container including a tubular wall and an upper opening thereto through a rim of said wall;

a rigid liner including a tubular wall, an upper opening at a rim of said wall, and a bottom and disposed for placement in said container through the opening of the container;

said liner adapted for receiving a trash bag through the opening of said liner;

said liner dimensioned for insertion within said container with said liner opening in a fixed relation to said container opening and to thereby form an annular space between said liner wall and said container wall, the annular space terminating at the upper openings;

said liner including a liner flange provided on the rim of the liner wall and cooperative with said container to contribute to defining the annular space;

said liner wall including a plurality of apertures around and down its tubular wall from a location proximate said opening to a location proximate said bottom, said apertures communicating from the interior of said liner to said annular space when said liner is inserted into said container;

an exhaust aperture through the container;

air blower means for withdrawing air from said annular space and the liner apertures through said container exhaust aperture wherein air pressure is reduced in said annular space and the trash bag is simultaneously held against and deployed progressively down said liner wall responsive to operation of said air blower means whereby the deployment of said bag against said liner wall retains upper portions of said bag proximate said liner rim as said bag is deployed down said liner wall.

2. The vacuum-operated trash receptacle of claim 1 wherein said plurality of apertures comprises a plurality of elongated openings provided in spaced-apart relationship with respect to each other in said liner.

3. The vacuum-operated trash receptacle of claim 2 wherein said plurality of elongated openings extend in a direction between said rim and said liner bottom provided in spaced-apart relationship with respect to each other in said liner.

4. The vacuum-operated trash receptacle of claim 1 wherein said container is further defined by a container bottom closing one end of said container wall and wherein said air blower means for withdrawing air is provided on said container bottom.

5. The vacuum-operated trash receptacle of claim 1 wherein said container has a container bottom closing a first end of said tubular wall and wherein said means for withdrawing air is provided on said tubular wall.

6. The vacuum-operated trash receptacle of claim 1 wherein said plurality of apertures is provided in spaced-apart parallel relationship with respect to each other in said liner.

7. The trash receptacle of claim 1 wherein said air blower means is fixedly attachable or removably attachable to the trash receptacle.

8. The vacuum-operated trash receptacle of claim 1 further comprising a perforated container lid;

the container further including a container flange extending around an end of the tubular wall opposite a container bottom; and the liner bottom spaced from said container bottom to define the annular space and the liner flange structured and arranged to engage the container flange for removably receiving the container lid; and wherein said air blower means for withdrawing air is mounted on said container bottom.

9. The vacuum-operated trash receptacle of claim 1 comprising a perforated container lid;

the container further including a container flange extending around an end of said tubular wall opposite a bottom end, and said liner further including a liner flange on the rim, said liner wall spaced from said tubular wall to define said annular space and said liner flange structured and arranged to engage container flange for removably receiving said container lid; and wherein said means for withdrawing air is mounted on said container wall.

10. The vacuum-operated trash receptacle as recited in claim 1 further comprising a timer activatable for one or more time intervals to operate said blower for that time interval.

11. The vacuum-operated trash receptacle as recited in claim 1, wherein the deployment of the bag against the liner wall creates a air-tight seal therebetween.

12. The vacuum-operated trash receptacle as recited in claim 1, wherein the installed bag at the liner and container rims creates a air-tight seal therebetween.

* * * * *